United States Patent [19]

Drews et al.

[11] 4,015,563

[45] Apr. 5, 1977

[54] STABILIZED FUEL INJECTION SYSTEM

[75] Inventors: Ulrich Drews, Vaihingen-Pulverdingen; Lothar Winkelmann, Ludwigsburg; Peter Werner, Stuttgart, all of Germany

[73] Assignee: Robert Bosch G.m.b.H., Stuttgart, Germany

[22] Filed: Aug. 27, 1975

[21] Appl. No.: 608,211

[30] Foreign Application Priority Data

Sept. 23, 1974 Germany ..... 2445317

[52] U.S. Cl. ..... 123/32 EH; 123/32 EA; 123/32 ED

[51] Int. Cl.[2] ..... F02B 3/00

[58] Field of Search ..... 123/32 EA

[56] References Cited

UNITED STATES PATENTS

| | | | |
|---|---|---|---|
| 3,543,734 | 12/1970 | Mair | 123/32 |
| 3,620,196 | 11/1971 | Wessel | 123/32 |
| 3,727,081 | 4/1973 | Davis | 307/260 |
| 3,742,919 | 7/1973 | Suda | 123/32 |
| 3,747,575 | 7/1973 | Eisele | 123/32 |
| 3,929,108 | 12/1975 | Monpetit | 123/32 |

*Primary Examiner*—Ronald B. Cox
*Attorney, Agent, or Firm*—Flynn & Frishauf

[57] ABSTRACT

To prevent bucking of a fuel injection operated automotive engine, under transient dynamic conditions, due to resilient suspension thereof, a timing capacitor in the fuel injection system has an auxiliary capacitor connected in parallel thereto over a diode, the auxiliary capacitor having its own charge circuit, and the diode and charge circuit being so arranged that the diode becomes conductive when the voltage across the main capacitor exceeds the voltage across the auxiliary capacitor, thus delaying and flattening the charge rate to the main capacitor without, however, detracting from total charge being placed on both capacitors to prevent excessive changes in fuel valve injection timing under transient engine operating conditions.

9 Claims, 11 Drawing Figures

$$U_{EB} + U_{C1} = U_{D1} + U_{C2} \quad \text{———} \quad (1)$$

$$to = \frac{1}{2n} \cdot \frac{Ia + Iz - I1\left(2 + \frac{C1}{C2}\right)}{Ia + Iz + I1\,\frac{C1}{C2}} \quad \text{———} \quad (2)$$

$$tp = \frac{1}{2n} \cdot \frac{Ia + Iz - 2\,I1}{Ie} \quad \text{———} \quad (3)$$

STABILIZED FUEL INJECTION SYSTEM

CROSS REFERENCE TO RELATED PATENTS

U.S. Pat. Nos. 3,483,851, Reichardt, and 3,874,171, Ser. No. 453,015, all assigned to the assignee of the present application.

The present invention relates to electronic fuel injection systems for use with automotive-type internal combustion engines in which at least one electromagnetically operated fuel injection valve is repetitively energized by a control circuit responding to command and engine operating parameters.

Various types of automotive vehicles have fuel injections systems in which a fuel injection valve is opened in synchronism with rotation of the engine. At times, and under some operating conditions, it is possible that the speed varies in an oscillatory manner without regard to the command signal. This is disagreeable for the occupants of the automotive vehicle and detracts from accurate command of motor and vehicle performance. Such oscillations may result from an oscillatory system formed by the mass of the vehicle and of the internal combustion engine, the vehicle and the engine forming an elastic system due to the elastic suspension of the engine and the dependence on fuel injection on engine speed and engine air, or engine gasified fuel-air mixture supply.

It is an object of the present invention to so improve a fuel injection system that swings or oscillations in engine speed which result in bucking or vibration are effectively avoided.

SUBJECT MATTER OF THE PRESENT INVENTION

Briefly, the invention relates to a fuel injection system in which the timing of opening of the injection valve is controlled by a multivibrator which charges a capacitor, and then discharges the capacitor during a predetermined time period, the charge and discharge rate of the capacitor being controlled by engine operating perameters. In accordance with the present invention, the capacitor is connected over a diode to a second capacitor which preferably has a greater capacitance than the first capacitor. The second capacitor is connected to an additional charge current source which, during the charge time of the first capacitor, accepts a major portion of the charge current thereof and thus greatly decreases the charge rate of the first capacitor as soon as the voltage across the first capacitor exceeds the voltage across the second capacitor.

The invention will be described by way of example with reference to the accompanying drawings, wherein:

FIG. 1 is a general schematic diagram of a four-cylinder Otto-type internal combustion engine and a fuel injection system controlling fuel supply thereto;

FIG. 1*a* shows mathematical relationships;

Figures 1, 1A:
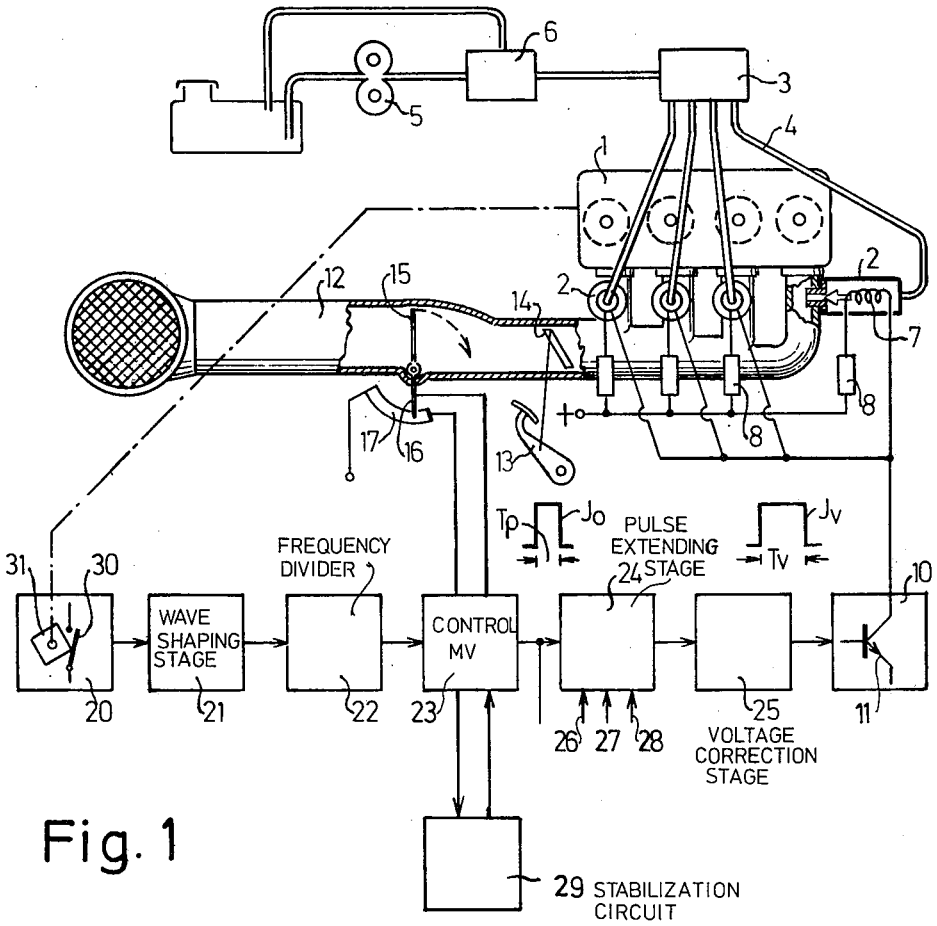

A four-cylinder, four-cycle Otto-type internal combustion engine 1 (FIG. 1), and using battery-type ignition, is supplied with four electromagnetically operated fuel injection valves 2, supplied with fuel from a fuel distributor 3 over individual fuel supply pipes 4. The fuel is supplied to the distributor 3 from a fuel tank T over a pump 5 and a pressure regulator which maintains fuel pressure at, for example, 2 atm. For a general discussion and specific diagrams of such a fuel injection system, reference is made to U.S. Pat. No. 3,483,851, Reichardt, assigned to the assignee of the present application. The electronic control system is triggered once for each revolution of the internal combustion engine, for example by a trigger pick-up associated with the ignition system thereof. It provides a square wave electrical opening pulse J$v$ for the fuel injection valves 2. The duration of the pulse J$v$, shown in FIG. 1 as T$v$, determines the open time of the fuel injection valve 2, and thus the quantity of fuel being injected which is emitted from the injection valves 2 during the open state of the respective valve.

The fuel injection valves 2 have electromagnetic control solenoids 7 (only one of which is shown in detail), which are series connected through a decoupling resistor 8 to a common power amplifier stage 10. Power amplifier stage 10 has at least one power transistor 11, the emitter-collector path of which is series connected with the solenoid windings 7. The emitter of transistor 11 is connected to ground, or chassis, of the automotive vehicle and hence to the negative terminal of a battery (not shown). The common line connected to the resistors 8 is connected to the positive terminal.

The air sucked into the engine through the induction pipe 12 is controlled by an accelerator pedal 13 operating a throttle 14. The quantity of air actually supplied can be measured in various ways, for example by measuring the vacuum in the induction pipe or, as shown, by a deflection vane or flap 15 which can deflect counter the force of a reset spring (not shown). The distance of deflection depends on the quantity of air being sucked into the engine. The deflection flap 15 is coupled to the slider 16 of an electrical potentiometer 17, which supplies a control voltage for the electronic fuel injection control system representative of the position of the deflection flap 15.

The electronic control system is triggered by a trigger signal source 20. It includes a wave-shaping stage 21, a frequency divider 22, a control multivibrator (MV) 23, a pulse-extending stage 24 and a voltage correction stage 25. Voltage correction stage 25 compensates for the influence of battery voltage on the opening time of the injection valves upon change in battery voltage with constant timing T$v$ of the output pulse. The control MV 23 provides control pulses *Jo* at the output thereof. The time duration T*p* of the control pulses *Jo* depends on the position of the flap 15 in the induction pipe 12 of the engine and is controlled by the position of the slider 16 of potentiometer 17. The timing additionally depends on the speed of the engine. The control pulses *Jo* are extended in the pulse-extending stage 24 by a factor *f* which depends on the position of the throttle 14, by having a signal applied to terminal 26; on the running condition of the engine, that is, whether it is being started, or has just been started, or is running smoothly and properly, as determined by a signal applied to terminal 27; and on engine temperature, as determined by a temperature signal applied through terminal 28. Other correction signals may be introduced to the pulse-extending stage 24, for example signals representative of composition of the exhaust gases from the engine. The control pulses *Jo*, as corrected and extended in the pulse-extending stage 24, are then extended or reduced by a fixed value depending on vehicle battery voltage in the voltage correction stage 25 to compensate for changes in opening and closing rates of the fuel injection valve as the battery voltage changes. The pulses are extended if the battery voltage drops, to compensate for slower operation of the valves. The finally processed pulses are then applied to the power transistor 11 of the power stage 10.

The various pulses *Jv* and hence the pulses *Jo*, commencing simultaneously with the pulses *Jv*, are triggered synchronously with revolution of the internal combustion engine. The breaker cam 31, opening and closing the ignition breaker contacts 30 forming part of the distributor (or equivalent non-contacting systems) is used to provide the trigger pulses for the fuel injection system. The signal is derived from the fixed breaker contact 32 (FIG. 2) connected to the primary winding 33 of the ignition system of the engine.

Figure 2:
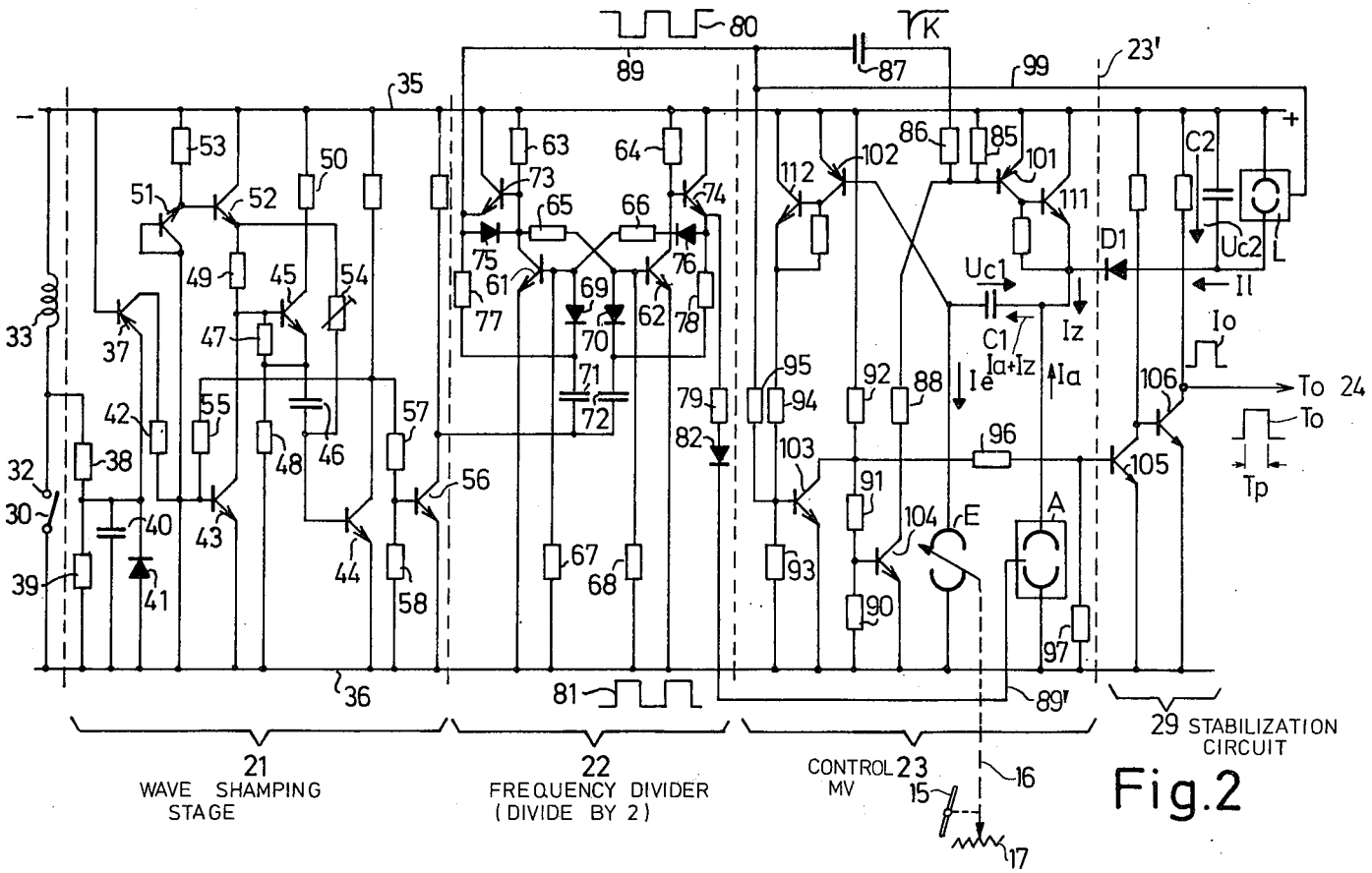
FIG. 2 is a simplified general schematic circuit diagram of components of the system of FIG. 1.

FIG. 2 illustrates a circuit which can be provided in integrated circuit technology. The wave-shaping stage 21 has an input circuit which ensures that erroneous trigger signals cannot pass through the system; such erroneous signals may be generated by noise signals or noise waves arising on the supply lines to the system, that is, between the buses 35, 36 representing the common positive and negative supply lines respectively. Such pulses may arise upon sudden connection or disconnection of other loads connected to the battery. Essentially, the input stage includes a lateral pnp transistor 37, the base of which is connected to positive bus 35. The emitter is connected to the tap point of a pair of resistors 38, 39 connected as voltage dividers, the resistors being connected across the switch 30. A capacitor 40 and a diode 41 are connected in parallel to the voltage divider resistor 39, the anode of the diode being connected to negative bus 36. Transistor 37 can be conductive only when the voltage at its emitter becomes higher than the voltage at the base connected to the positive bus 35. This condition can arise only when the breaker contact 30 opens, that is, lifts off the stationary contact 32. A high inductive voltage peak will result in the primary winding 33, which is a multiple of the voltage between buses 35, 36. The voltage divider 38, 39 sets the response threshold of the transistor 37 at such a level that only such high voltage peaks can cause transistor 37 to become conductive for a short pulse period. A resistor 42 connect the collector of transistor 37 to the base of an npn transistor 43 which, together with a second npn transistor 44, a coupling capacitor 46 and a transistor 45, forms a monostable multivibrator (MV) or flip-flop (FF) circuit. The base of transistor 45 is connected to the collector of transistor 43 and, further, is connected through two resistors 47, 48 to negative bus 36. The junction of the two series-connected resistors 47, 48 is connected to the emitter of transistor 45, and to coupling capacitor 46. Transistor 45 provides for rapid re-charging of coupling capacitor 46 so that the recovery time of the monostable FF is short and so that the instability period of the monostable FF is not decreased if it is retriggered into unstable state immediately after return to the stable state as a result of a rapidly succeeding second triggering pulse. A transistor 51, operating as a Zener diode due to its short-circuited base-collector path, has its emitter connected to the base of an emitter-follower npn transistor 52. Its emitter is likewise connected over an emitter resistor 53 to positive bus 35. Transistor 52, in combination with transistor 51, ensures that coupling capacitor 46 is always charged to the same voltage level independently of swings in battery voltage, so that the unstable time of the monostable MV, or FF, will always be the same independently of battery or supply voltage variation.

Resistor 48, connected between the emitter resistor 47 of transistor 45 and negative bus 36, is provided to ensure conductivity of transistor 45 after capacitor 46 has charged, which occurs rapidly when transistor 45 is conductive. The emitter of transistor 45 is thus held at a predetermined fixed voltage which it reaches only after the rapid charging of the capacitor 46. This system prevents change in the unstable time of the monostable MV formed of transistors 43, 44 with changes in speed of the internal combustion engine, that is, with changes in repetition rate of the pulses applied across contacts 30, 32.

In quiescent state, transistor 44 of the MV is held in conductive state by resistor 54 connected to the emitter of transistor 52, so that not only transistor 43 is blocked over the feedback resistor 55 but the output transistor 56 of the pulse wave-shaping stage 21 as well. Output transistor 56 has its base connected through coupling resistor 57 to the collector of transistor 44, and to a base resistor 58 which connects to the negative bus 36. Resistors 57, 58 together form a voltage divider circuit.

Frequency divider 22 is connected to the wave-shaping stage 21. The frequency divider 22 is connected as a bistable MV or FF, and includes two npn transistors 61, 62, both of which have their emitters connected to negative bus 36. Their collectors are connected by respective load resistors 63, 64 to positive bus 35. The bases of transistors 61, 62 are cross-connected to the collector of the opposite transistor through resistors 65, 66 respectively, and further to respective base resistors 67, 68, connected to the negative bus 36. The bases of the transistors 61, 62 are further connected to the anodes of respective diodes 69, 70, the cathodes of which are connected to coupling capacitors 71, 72, respectively, which are commonly connected and to the output of the waveshaping stage 21, that is, to the collector of transistor 56. The collector resistors 63, 64 have oppositely poled output voltages appear thereat. These voltages are derived separately, and without interconnecting feedback or mutual influence by two respective emitter follower transistors 73, 74 having their respective bases connected to the collectors of the respective transistors 61, 62. The emitter-base path is bridged by a respective diode 75, 76, poled to be conductive in opposite direction. The emitter of transistor 73 and the anode of diode 75 are connected by a resistor 77 to the junction of diode 69 and coupling capacitor 71. This circuit delivers the output voltage 80 appearing at line 89. The emitter of transistor 74 and the anode of diode 76 are connected by resistor 78 to the junction of diode 70 and capacitor 72, and supply through a resistor 79 and a seriesconnected diode 82 an output signal 81 on line 89'.

Operation of frequency divider stage 22: The two transistors 61, 62 are in opposite state of conductivity. Upon opening of the breaker contacts 30, 32, output transistor 56 of wave-shaping stage 21 becomes conductive. As a result, that one of the transistors 61, 62 will block which previously was conductive; the other one, which previously was blocked, becomes conductive. Thus, one of the ignition events which makes one of the transistors conductive causes, at the next event, the other transistor to be conductive. The voltage 80, at line 89, arising at the collector of transistor 61 and hence at the emitter of transistor 73 will have the undulating form indicated in FIG. 2. The frequency of the voltage 80 is only half that as the frequency due to opening and closing of the signal derived from contacts 30, 32.

The control multivibrator 23 uses the principle that the timing capacitor C1 is charged from a constant current source during the time that the crankshaft of the IC engine 1 passes through a predetermined angle; thereafter, the capacitor is discharged over a second constant current source (or, rather, constant current-accepting sink). The control pulse *Jo* indicated in FIG. 1 is generated during the discharge time of capacitor C1. A constant current source A supplies capacitor C1 with a constant charge current Ia independent of the quantity of air being sucked in by the engine through the induction pipe 12. The discharge of the capacitor occurs with a discharge current I*e* which is derived from the discharge source E and in which the current is inversely proportional to the quantity of air sucked in by the engine, as measured by the flap valve 15, the position of which is measured on potentiometer 17 (FIG. 1). In addition to the storage and control capacitor C1, control MV has two pnp transistors 101, 102, having their respective emitters connected to positive bus 35. They are coupled to respective transistors 111, 112 and operated in an LIN circuit. Transistor 101 has its base connected over a resistor 85 with positive bus 35 and thus is held in block state in quiescent condition of the MV circuit. Its base is further connected over a coupling resistor 86 and a coupling capacitor 87 to the line 89 supplying the signal 80 derived from frequency divider stage 22. The base of transistor 101 is further connected over resistor 88 to the emitter of an npn transistor 104, the emitter of which is connected to negative bus 36. The base of transistor 104 is connected to a voltage divider formed of resistors 90, 91. Resistor 90 is connected to the negative bus 36, and resistor 91 is connected to the collector of an input transistor 103 as well as to a further resistor 92 connected to positive bus 35. Input transistor 103 has its base connected to the junction of two resistors 93, 94 connected to the collector circuit of the LIN circuit including transistors 102, 112. The base of transistor 103 is further connected through a resistor 95 to line 89, and hence to the switching signal 80. The collector of transistor 103 is further connected through a resistor 96 to the base of a transistor 105. A resistor 97 also connects the base of transistor 105 to negative bus 36. Transistor 105 controls a further transistor 106, from the collector of which the control pulses *Jo* can be derived depending both on speed of the engine as well as on quantity of air passing to the engine.

Figure 3:
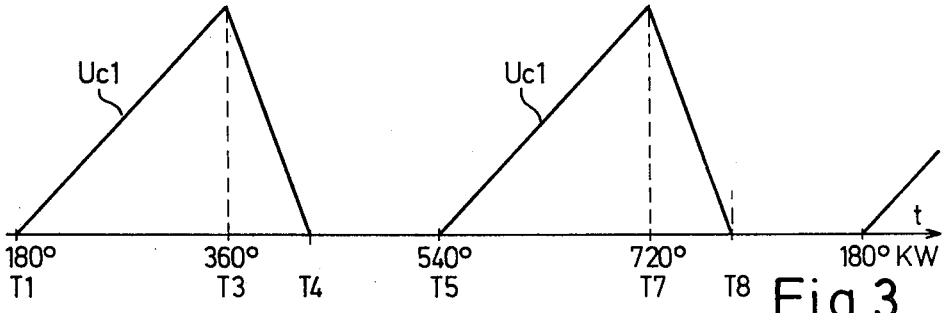
FIG. 3 is a timing diagrm illustrating timing of the charge and discharge capacitor of the system of the prior art.

Operation — with reference to FIG. 3: Considering first the generation of the control pulses *Jo* without the stabilization circuit to the right of the broken line 23' (FIG. 2). Main capacitor C1 is charged with a constant charge current I*a* during the time that the crankshaft passes through a fixed angle of rotation, for example 180°. The time for the respective charge extends from a crankshaft position of 180° to 360°, and then from 540° to 720° upon the second rotation of the crankshaft. In a four-cycle engine, two full rotations of the crankshaft are required for a complete cycle. During the charge time the voltage 80 is positive, the voltage 81, controlling the charge source A, is at 0 voltage at this time. The charge current Ia flowing from the instant of time T1 (FIG. 3) to T3 causes a linearly rising charge voltage U*c*1 across capacitor C1. The final value at time T3 is reached at crankshaft position 360°, and 720°, respectively. The final, or peak voltage is inversely proportional to the instantaneous speed of the internal combustion (IC) engine. Transistors 101 and 111 are blocked during this charge time; transistors 102, 112 are conductive and hold transistor 101 as well as complementary transistor 104 in blocked state since transistor 103 will be conductive. This state is further ensured by control of the transistor 103 directly by means of voltage 80 from line 89 over resistor 95. This prevents premature termination of charging of capacitor C1 due to possible voltage drops at positive bus 35.

The charge time is terminated at instant T3, that is, at crankshaft positions of 360° and 720°, when the voltage 80 on line 89 drops from its previous positive, or 1-signal, to a 0-signal or 0-voltage. The differentiating capacitor 87 connected to line 89 transmits a negative trigger pulse K to the base of transistor 101 when the voltage 80 changes to zero, thus causing transistor 101 to become conductive. Simultaneously, the voltage 81 on line 89' blocks constant current source A. The charge on storage capacitor C1 blocks the previously conductive transistors 102, 112, which also causes transistor 103 to change into blocked state. Transistor 104, however, becomes conductive.

The discharge portion of the cycle now begins. During discharge of the capacitor C1, the discharge source E provides for a constant discharge current I*e*, which has the effect that the voltage Uc1 across storage capacitor C1 drops linearly. As soon as this voltage has reached a predetermined value which is close to the zero or null value, transistor 102 can no longer be held in blocked state, and transistor 102 will change to conductive state and causes transistor 103 again to become conductive in spite of the still prevailing 0-signal of the control voltage 80, since collector current can flow to transistor 104 over resistor 94. The feedback circuit connected to transistor 103 causes immediate blocking of transistor 104. This is the instant of time shown in FIG. 3 at T4, and the control pulse Jo is terminated.

Figure 4:
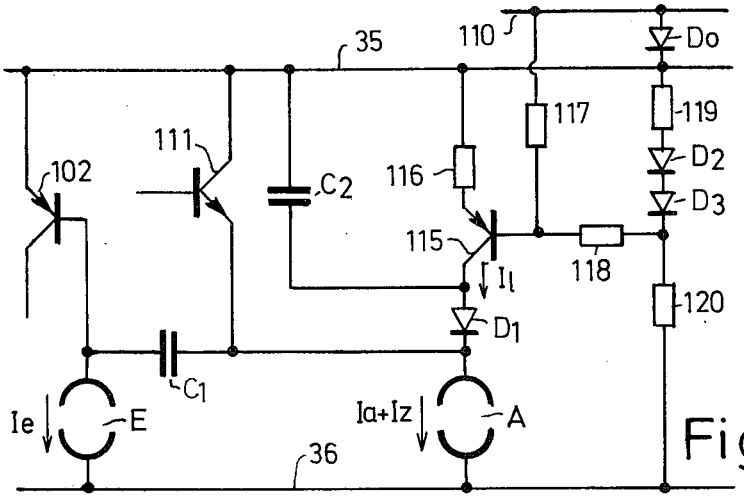
FIG. 4 is a detailed schematic circuit diagram of a first embodiment of the stabilization circuit in accordance with the present invention, including the second capacitor, added to the basic system of FIG. 1 and FIG. 2.

The oscillating system which may result due to the swinging or resilient suspension of the engine on the frame may cause bucking, vibrations, and undesirable harmonic variations in engine speed. To prevent such bucking, the stabilization circuit to the right of broken line 23' is provided. This circuit is connected to the charge circuit A, and includes a second capacitor C2 which has a substantially higher capacitance value than capacitor C1. The circuit includes an additional charge current source L and a diode D1 which drains a substantial portion of the charge current from the first capacitor C1 to the second capacitor C2 if the voltage at the first capacitor C1 exceeds that of the second capacitor C2, thus substantially delaying the charging rate on capacitor C1. Control line 99, connected to line 89 (FIG. 2) may be provided in order to control operation of current source L in synchronism with the signals 80 appearing on line 89. This system is used in the embodiment of FIG. 6, and explained in FIG. 8, but is not strictly necessary. In the embodiment of FIG. 4, a constant current I1, independent of time, is fed to the capacitor C2.

FIG. 4 illustrates one embodiment of the stabilization circuit in detail. The basic components, capacitor C2, diode D1, are shown, as well as a transistor 115 having its emitter connected over an emitter resistor 116 to the positive bus 35. The collector is connected to the anode of the diode D1, the cathode of which is connected to the first or main charge capacitor C1, as well as to the emitter of transistor 111 and to the output terminal of the charge current source A.

Figure 5:
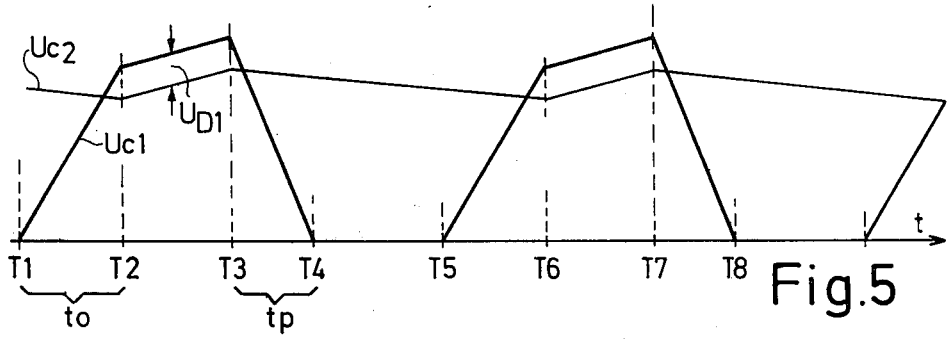
FIG. 5 is a timing diagram illustrating the effect of the stabilization circuit.

Charge current source A, as well as the discharge current source E, are only schematically indicated; these two constant current sources may be identical and may be constructed in, for example, FIGS. 4 and 5, respectively, as shown in German Disclosure Document DT-OS 2,242,795 U.S. Ser. No. 392,877; they can be made as units by integrated circuit technology.

Current I1 delivered by transistor 115 should be essentially independent of temperature. To this end, transistor 115 is coupled with its base over a resistor 117 directly to a supply line 110 connected over a diode D*o*, to prevent damage to the integrated circuit due to false polarity connection. The base of transistor 115 is further connected through a base resistor 118 to a voltage divider, one branch of which includes a resistor 119 and two series-connected diode D2, D3, the other branch of which being formed by a fixed resistor 120.

Operation of the stabilization circuits of FIG. 4, with reference to FIG. 5: During the period of time from T1 to T2, capacitor C1 is charged with the total current forming the sum of currents I*a* and I*z*; at time T2, the voltage Uc1 across capacitor C1 exceeds the voltage Uc2 at the second capacitor C2. This causes diode D1 to become conductive and the total current I*a* + I*z* now distributes over both parallel connected capacitors C1 and C2. This substantially reduces the rate of voltage rise across capacitor C1. The time period T2 is determined by relationship (1), in which $U_{EB}$ designates the voltage drop across the emitter-base path of the transistor 102, and $U_{D1}$ is the threshold voltage of diode D1. Duration to of the first portion of the charge cycle, occurring at a high rate, between periods of time T1 and T2 is determined by relationship (2) in which current I*l* designates the current supplied by transistor 115 (FIG. 4).

The charge current source A is disconnected at time period T3 by signal 81 over line 89. Simultaneously, the discharge portion of the cycle begins, triggered by the trigger pulse K. A constant discharge current I*e* flows from capacitor C1. The discharge is terminated at time T4 (FIG. 5) and the discharge time *tp* which determines the duration of the pulse J*o* is determined by relationship (3). The duration *tp* of the pulse J*o* is correctly set when I*z* = 2 I*l*.

Diode D1 blocks at instant T3. The capacitor C2 is discharged by the current I1 supplied by the transistor 115 until the next time T6 in the next charge cycle. Starting from the period of time T5, the first or main capacitor C1 is again charged with the current I*a* + I*z*. At period of time T6, diode D1 again becomes conductive so that the parallel connection of both the main capacitor C1 and the auxiliary capacitor C2 provides charge current to the two capacitors defined by I = I*a* + I*z* − I*l*. Starting at time T7, both capacitors are discharged separately.

Figure 10:
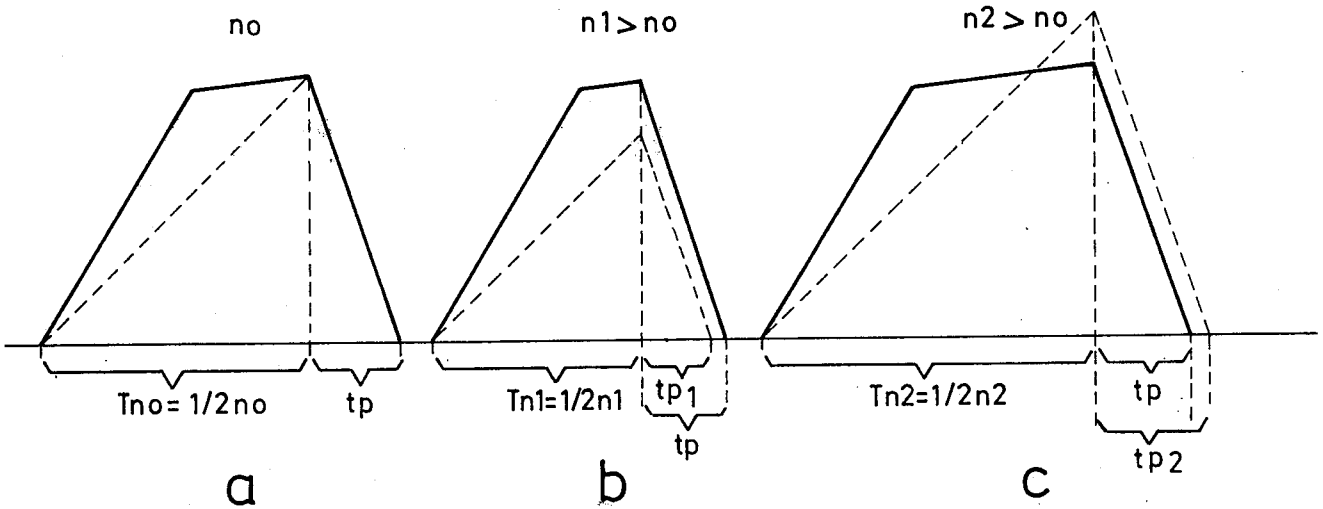
FIG. 10 is a timing diagram illustrating the influence of the stabilization circuit in accordance with the present invention upon dynamic changes in speed of the engine.

Operation under dynamic conditions: The above considerations assumed a constant speed. Under such steadystate conditions, the currents I*z* and I1 can be so adjusted that the circuit does not change pulse duration T*o*. The stabilization circuit has an advantageous effect, however, upon dynamic change in speed, as will be illustrated in connection with two jumps or sudden changes in speed from a base speed *no* . Referring to FIG. 10, graph 10*a* illustrates steady-state operation; graph 10*b* illustrates the voltage at main capacitor C1 which arises immediately after the speed has suddenly changed to a higher value, and specifically when the speed *no* has increased by about 30% to a higher value *n*1. Graph 10*c* illustrates the condition when the steady-state speed no suddenly drops by 20% to a lower value *n*2.

The rise in voltage across the first capacitor C1 is indicated in the timing diagrams in broken lines assuming that the circuit only includes the portion up to the broken line 23' (FIG. 2), that is, without the stabilization circuit to the right thereof; the voltage across the capacitor using the stabilization circuit is indicated in solid lines.

It is assumed in the presentation of FIG. 10 that at a speed no the pulse duration *tp* will result. Upon a sudden jump in speed to a higher speed *n*1, a shorter charge time T*n*1 will result which has as a result a substantially shorter pulse period *tp* 1 than the pulse period *tp* obtained by using the stabilization circuit in accordance with the present invention. Thus, as higher speed results, a richer fuel-air mixture will be supplied. Upon transition to a lower speed, as indicated by graph 10*c*, a pulse duration *tp* will result which is shorter than the duration *tp* 2 absent the stabilization circuit. This is due to the increased period of time that the voltage rises slowly across the main capacitor C1 during the periods of time T2 and T3. All three graphs of FIG. 10 assume that the same charge currents flow for the various speeds shown, and that thus the voltage graphs have the same slope. Also, all three graphs assume a same discharge current I*e*.

The effect of the stabilization circuit thus is to provide a somewhat richer mixture upon transition from a base speed to a higher speed and a leaner mixture upon transition to a lower speed. To effect this advantageous result, the second or auxiliary capacitor C2 should have a greater capacitance value than the main capacitor C1. Capacitor C2, preferably of higher capacity, is charged only during a short period of time, compared to the overall charge period T, or I*no*, T*n*1, and T*n*2, respectively. In order to bring the second auxiliary capacitor C2 to a higher charge voltage corresponding to a new, lower speed requires several charge cycles. The discharge current I1 delivered by transistor 115 which controls the discharge of the second capacitor C2 is set to be so low that several discharge cycles are needed in order to bring the capacitor C2 to a lower charge voltage, representative of a higher engine speed.

Figure 6:
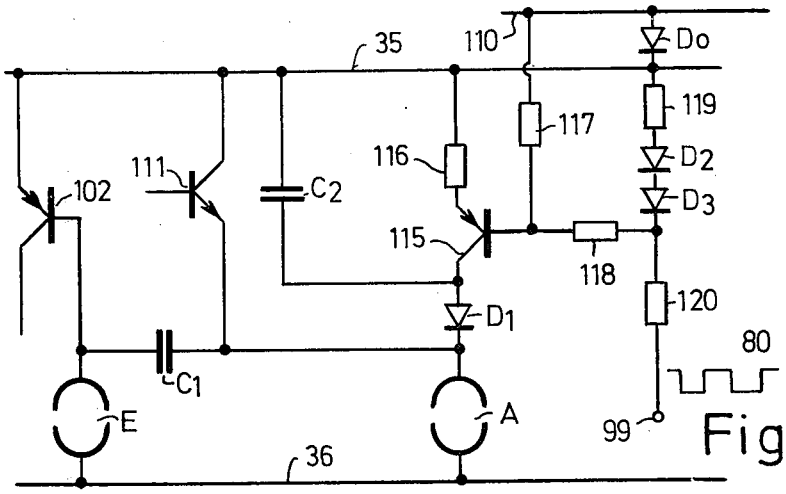
FIG. 6 is a schematic circuit diagram of another embodiment of the stabilization circuit.
Figure 8:
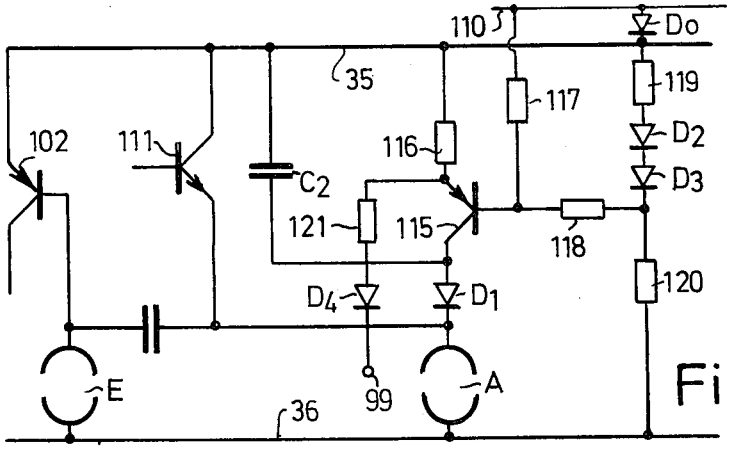
FIG. 8 is a schematic circuit diagram of yet another embodiment of the stabilization circuit of the present invention.

In the embodiments of FIGS. 6 and 8, charge current source L formed by transistor 115 is not continuously conductive, as in FIG. 4, but rather is pulsed in synchronism with the signals 80, 81 delivered over lines 89, 89′, respectively, by the frequency divider stage 22.

Figure 7:
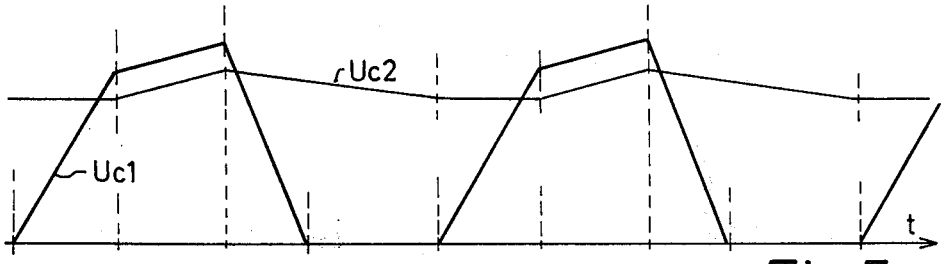
FIG. 7 is a timing diagram illustrating the operation of the circuit of FIG. 6.

FIG. 6: The resistor 120 is not connected to the negative bus 36 but rather is connected to line 99, that is, to signal 80. Transistor 115 is held conductive during the period of time that charge current source A is disconnected, and will block when the charge current source A provides the charge current I*a*. The voltage U*c*2 across the auxiliary capacitor C2 thus remains essentially constant between the period of time T1 and T2, as well as between T5 and T6 (see FIG. 7).

In the embodiment of FIG. 8, transistor 115 is held to be conductive and supplies the discharge current I1 for the auxiliary capacitor C2 during the period of time that the charge current source A is supplying current. It is, therefore, connected together to the charge current source A and is disconnected together with the charge current source A by the voltage 80 applied over terminal or line 99. To this end, the emitter of transistor 115 is connected to the signal 80 through the series connection of a diode D4 and a resistor 121.

Figure 9:
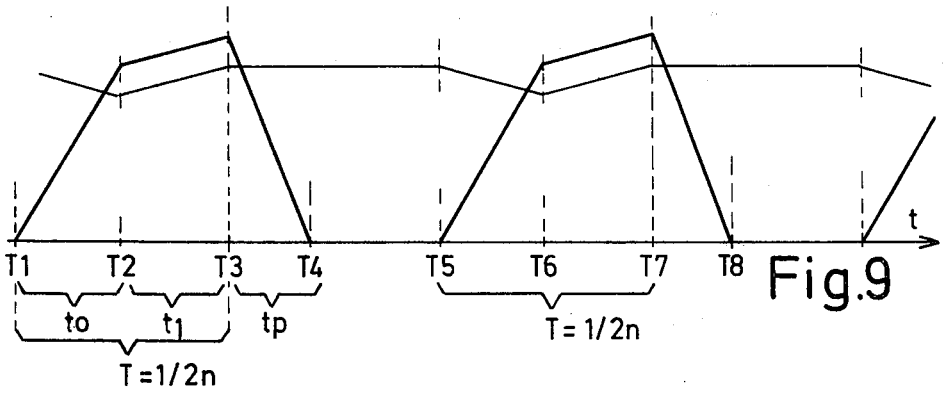
FIG. 9 is the timing diagram illustrating operation of the circuit of FIG. 8.

Operation of the circuit of FIG. 8 with reference to FIG. 9: When the charge current source L, that is, transistor 115, is operated in direct synchronism with the signal 80, current I1 of the source L (transistor 115) can be set to be higher than in the permanently connected arrangement as illustrated in FIG. 4. In the system shown, the charge current source including transistor 115 and the two diodes D2, D3 as well as the resistors 116–120 provide a current I1 which, similar to the currents I*a* + Iz and the discharge current Ie are proportional to, or representative of the supply voltage at the positive bus 35 and, additionally, are temperature-compensated, so that the pulse duration tp, as defined in relationship (3) is independent of battery voltage and ambient temperature.

Various changes and modifications may be made within the scope of the inventive concept. Relationships (1), (2) and (3) are reproduced on sheet 1 of the drawings.

We claim:

1. In a fuel injection system for an internal combustion engine (1) having at least one fuel injection valve (2, 7) controlling flow of fuel to the engine during the opening time of the valve;

means 20, 21, 22) generating an electrical pulse in synchronism with rotation of the engine, said pulse having a pulse duration representative of speed of the engine;

a main capacitor (C1);

a charge circuit (A) controlled by the pulse generating means connected to charge the main capacitor (C1) during said pulse;

a discharge circuit (E) controlled by an operating parameter of the engine connected to discharge said main capacitor (C1) at a rate controlled by said engine operating parameter, and generating a timing pulse during the time of discharge of said main capacitor (C1);

and connecting circuit means (24 25, 10) applying an opening pulse to the fuel injection valve, or valves (2, 7) having a time duration controlled at least in part by said timing pulse;

a stabilization circuit (29) to stabilize the charge rate of the main capacitor (C1) under transient engine operating conditions comprising an auxiliary capacitor (C2);

a charge circuit (L) connected to the auxiliary capacitor (C2);

and a diode coupling the auxiliary capacitor in parallel with the main capacitor (C1), the diode being poled to permit current flow from the main capacitor to the auxiliary capacitor when the voltage across the main capacitor exceeds the voltage across the auxiliary capacitor to thereby decrease the rate of charge on the main capacitor as supplied by said main capacitor charge circuit (A).

2. System according to claim 1, wherein the auxiliary capacitor (C2) has a capacitance which is larger than the capacitance of the main capacitor (C1).

3. System according to claim 1, wherein the auxiliary charge source (L) comprises a transistor (115) having its emitter-collector path connected to a source of supply (35) and to the diode (D1), and to one electrode of the auxiliary capacitor (C2), respectively, the other electrode of the capacitor being connected to the supply source.

4. System according to claim 3, wherein a series circuit formed of a resistor (119) and at least one additional diode (D2, D3) is provided, connected to said supply source (35) with one terminal, the other terminal being connected to the base of the transistor (115).

5. System according to claim 4, further comprising a resistor (120) connecting the base of the transistor to the other terminal of the supply source (36).

6. System according to claim 1, further comprising a control circuit (99) connected to the auxiliary charge source (L) and pulsing the charge source in synchronism with energization of the main capacitor charge circuit (A) as controlled by said pulse generating means.

7. System according to claim 6, wherein said auxiliary charge source (L) is energized during energization of the main capacitor charge source (A) and de-energized when the main capacitor charge source is de-energized.

8. System according to claim 6, wherein said auxiliary charge source (L) is de-energized during energization of the main capacitor charge source (A) and is energized during deenergization of said main capacitor charge source.

9. System according to claim 3, further comprising a resistor (117) connecting the base of the transistor (115) to one of the terminals of the supply source.

* * * * *